United States Patent [19]

Dürr et al.

[11] 3,952,699

[45] Apr. 27, 1976

[54] METHOD AND APPARATUS FOR TREATING A WORKPIECE AT A TREATING STATION

[75] Inventors: Heinz Dürr, Stuttgart-Feuerbach; Klaus Gäfgen, Hemmingen, both of Germany

[73] Assignee: Otto Durr, Stuttgart-Zuffenhausen, Germany

[22] Filed: Mar. 19, 1974

[21] Appl. No.: 452,552

[52] U.S. Cl. ..... 118/315; 118/320; 118/321; 118/323; 118/633; 134/133; 427/424; 427/425; 427/184

[51] Int. Cl.[2] ..... B05C 11/12; B05C 5/00; B05B 13/04

[58] Field of Search ..... 118/315, 313, 316, 308, 118/309, 320, 321, 323, 326, 629, 630, 631, 633, 634; 134/45, 82, 83, 123, 133; 214/16.1 CD, 16.4 C

[56] References Cited

UNITED STATES PATENTS

| | | | |
|---|---|---|---|
| 1,734,065 | 11/1929 | Werotte | 214/16.1 CD |
| 2,019,182 | 10/1935 | Gipe et al. | 214/16.1 CD |
| 2,215,668 | 9/1940 | Smith | 118/316 |
| 2,598,246 | 5/1952 | Fowler | 118/321 |
| 3,132,655 | 5/1964 | Anderson | 134/82 |
| 3,662,905 | 5/1972 | Mizuno et al. | 214/16.1 CD |
| 3,765,856 | 10/1973 | Bowman | 118/315 |

*Primary Examiner*—Mervin Stein
*Assistant Examiner*—Douglas Salser
*Attorney, Agent, or Firm*—Michael S. Striker

[57] ABSTRACT

A workpiece, such as the body of a vehicle is advanced in suspended condition in one of two transversely spaced paths until it is opposite a treating station which is located between and spaced from both of the paths. There are several such treating stations provided, spaced along the paths, and they are each capable of affording a different treating action. The workpiece is placed opposite the desired work treating station and is then shifted transversely of the paths to the treating station where it undergoes treatment, to be subsequently shifted to the other of the paths and along the same.

12 Claims, 4 Drawing Figures

METHOD AND APPARATUS FOR TREATING A WORKPIECE AT A TREATING STATION

BACKGROUND OF THE INVENTION

The present invention relates generally to the treating of workpieces, and more particularly to a method of and an apparatus for treating of workpieces. Still more particularly, the invention relates to a method of treating a vehicle body or the like by providing it with a surface coating, and to an apparatus for carrying out the method.

The invention will be described herein with respect to the treating of vehicle bodies, but it should be understood that it can also be used for treating of other workpieces.

In the treating of vehicle bodies, and in particular in the applying of coatings to them, the industry desires to use electrostatic application of powder material as a surface coating for the bodies. Such electrostatic application of powder to an object, such as a vehicle body, is already known in the art. Two basic processes are known, according to one the vehicle body is pretreated, by cleaning it, washing it and phosphatizing it, whereupon the exterior surfaces of the vehicle body are sprayed with a neutral base coat. Subsequently, the vehicle body is internally painted electrophoretically and thereupon a cover lacquer is applied by spraying a liquid laquer of desired color onto the body. The application of the cover layer can take place in one and the same spray booth, even though two or more colors may be used for one and the same vehicle body. Of course, losses of paint from dripping or the like must be accepted, because paint lost in this manner is almost impossible to recover.

The other method known from the art does not use the application of a base coat of powder as in the preceding one, but instead pre-treats the workpiece as before and then immediately applies a base laquer to the inner and outer surfaces of the workpiece, usually electrophoretically. Thereupon, a finish coat is applied over the base coat by spraying color powder onto the base coat. This method has the advantage that it is substantially more economical than the first-mentioned one.

Unfortunately, the second method also has certain disadvantages. In the first-mentioned method in which liquid paints are utilized, the vehicle bodies can be readily and without interruption moved through the spray booths in sequence, even though the color of paint may have to be changed from one vehicle to another, or even two or more colors may have to be applied to one and the same vehicle body. If color changes are required when powder is used to apply a coating onto the vehicle body, however, this presents difficulties because in effect it is not possible to use one and the same cabin for spraying powder of different colors. It has been observed that in this case the different-color powders become readily admixed, especially because of the powder particles which continuously float in the air of the cabin. This means that for each color a separate spray booth or cabin must be provided.

This, in turn, would according to the prior-art approaches necessitate that the separate spray booths be located one behind the other, a requirement that necessitates extremely large installations. Moreover, even in this case it is virtually impossible to prevent the transfer of powder of one color from one booth to another booth wherein powder of a different color is used, as a workpiece travels seriatim through them.

SUMMARY OF THE INVENTION

It is an object of the present invention to overcome the disadvantages of the prior art.

More particularly, it is an object of the present invention to provide a method of treating a workpiece at a treating station, for instance applying powder or similar material to a vehicle body, in which the undesired transfer of color material from one spray booth to another is reliably avoided.

An additional object of the invention is to provide such a method wherein a plurality of individual spray booths can be provided, but which nevertheless requires substantially less space than what is known from the prior art.

An additional object of the invention is to provide an apparatus for carrying out the method.

In keeping with these objects and with others which will become apparent hereafter, one feature of the invention resides in a method of treating a workpiece at a treating station, particularly of surface-coating a vehicle body or the like, comprising advancing a workpiece in suspended condition in one of two transversely spaced paths until it is opposite a treating station which is located between and spaced from both of the paths. The workpiece is then shifted to the treating station transversely of the two paths, and it is treated at the treating station. Subsequently, the treated workpiece is again shifted transversely of the paths to the other one of them, and may then be removed in this other path.

Unlike the prior art, in which each workpiece passes through a sequence of spray booths, and in which only the spraying equipment of that booth is operated which sprays the particular desired color —with the result that the transfer of paint particles from one booth to another is never reliably excluded—, the present invention makes it possible to advance a workpiece through only one spray booth, and eliminates any possibility that the workpiece might have to pass through more than one of these booths. However, even if two, three or more spray booths are provided, they can be located quite close together so that the overall length of such an installation can be drastically decreased, thereby also decreasing the space requirements. This is further facilitated by the fact that the workpieces are advantageously suspended, and in particular that vehicle bodies can be suspended in such a manner as to be suspended in direction of their longitudinal axis, since this makes it possible to provide spray booths the cross section of which can be significantly smaller than was otherwise the case.

The present invention is particularly suitable for operations which are carried out stepwise, and it can be completely or partially automated, in which case it can be controlled by program control devices known from the art.

In essence, a workpiece travels in a substantially Z-shaped path, namely it travels first in one path, then moves at more or less right angles to this path to the treating station and from there to the other path which extends more or less parallel to the first one, and it then continues its movement in this other path. This makes it possible to carry out the treating in spray booths that can be made absolutely tight against the escape of powder or other matter, and avoids the possibility that material from one spray booth might be able to migrate into another one, even though both spray booths —or several of them— may simultaneously be operating on different workpieces.

Suspending the workpieces, especially suspending vehicle bodies along their longitudinal axis, is advantageous for another reason besides the ones mentioned above, namely because it permits a more uniform and thorough application of material, such as powder, to the surfaces of the vehicle body. This is so because all exterior parts of the vehicle body are particularly well exposed to the spray nozzles when the body is so suspended. This can be further improved by turning the vehicle body about a vertical axis to expose it still more completely to the spray nozzles. The spray nozzles may also be moved vertically with reference to the workpiece, or they may be moved in other directions relative to the workpiece, and of course it is possible —although not as practical— to so move the workpiece with reference to the spray nozzles.

Due to the fact that the vehicle bodies are suspended, a particularly advantageous geometric form of the spray booths may be selected, in such a manner that by appropriately configurating the walls of the spray booth a forced circular or spiral movement of the air and the color material particles —such as powder— can be obtained. Thus, a more uniform and reliable deposition of the material on the workpiece is assured, particularly if powder is involved in which case the charged powder particles will reliably become deposited on the workpiece as they travel in an essentially spiral path about the same.

Still another advantage of the invention is the fact that only a relatively small amount of air must be vented from the spray booths, and that this cuts down substantially on the loss of powder. Instead of operating continuously with fresh air, the present invention can readily use air flow in a closed circuit, the amount of air that must be turned over per unit of time being determined by the amount of powder that is sprayed and the maximum powder concentration in the air that is permissible from a safety point of view. Any excess powder that is carried by the air out of the spray booth can be recovered in appropriate devices which are well known from the art, becoming separated therein from the circulating air.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Before referring in detail to the several Figures it is pointed out that three concepts will be expressed herein which are a part of the state of the art and therefore require no detailed explanation. Reference will be made herein to deposition of matter by electrophoretic means, to electrostatic powder spraying, and to the so-called "power-and-free" advancement of workpieces. All of these concepts are well known in the art and reference may be had for further details to the Dictionary of Mining, Mineral and Related Terms, issued in 1968 by the U.S. Department of the Interior, and the sources cited therein.

Figure 1:
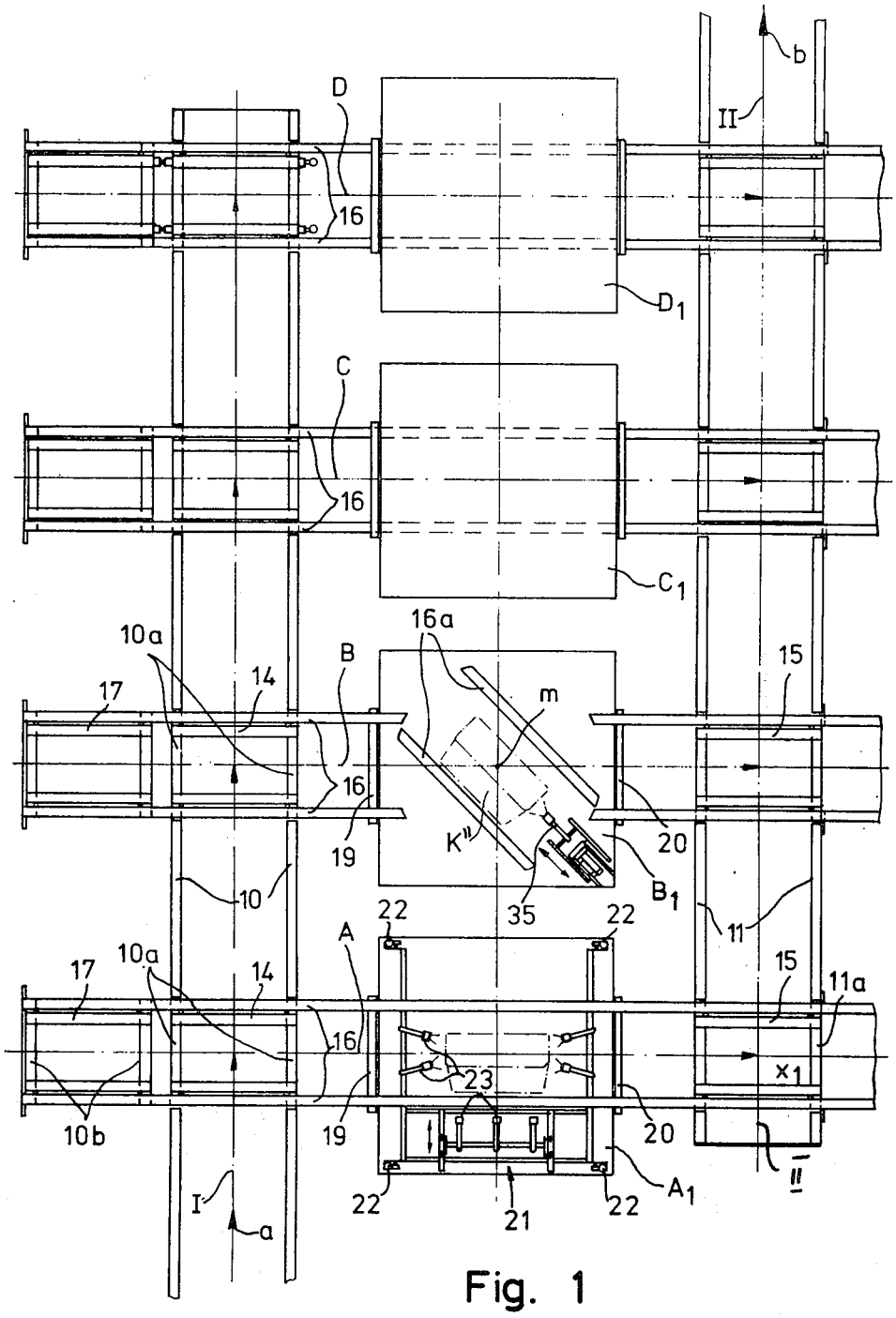
FIG. 1 is a somewhat diagrammatic top-plan view illustrating an apparatus in accordance with the present invention.

With this in mind, and referring firstly to FIG. 1, it will be seen that the novel apparatus comprises two tracks or paths I and II, which are composed of rails 10 and 11, respectively. For purposes of explanation it will be assumed that workpieces are supplied on the track I in the direction of the arrow *a*, and are removed on the track II in the direction of the arrow *b*. In this embodiment, the apparatus comprises four transverse rails A, B, C, and D, and it will be assumed that there are to be four painting stations provided, which are identified with reference characters $A_1$, $B_1$, $C_1$ and $D_1$, respectively. It will be further assumed that at each of these painting stations there is to be provided a spray arrangement capable of spraying a different color than at the other arrangements. The overall operation of the apparatus is according to the aforementioned power-and-free system in which the workpieces travel part of the way under power and part of the way freely, so that they can be manually advanced or can be moved under the control of a power source different from the one which advances them in the tracks I and II, respectively.

Figure 2:
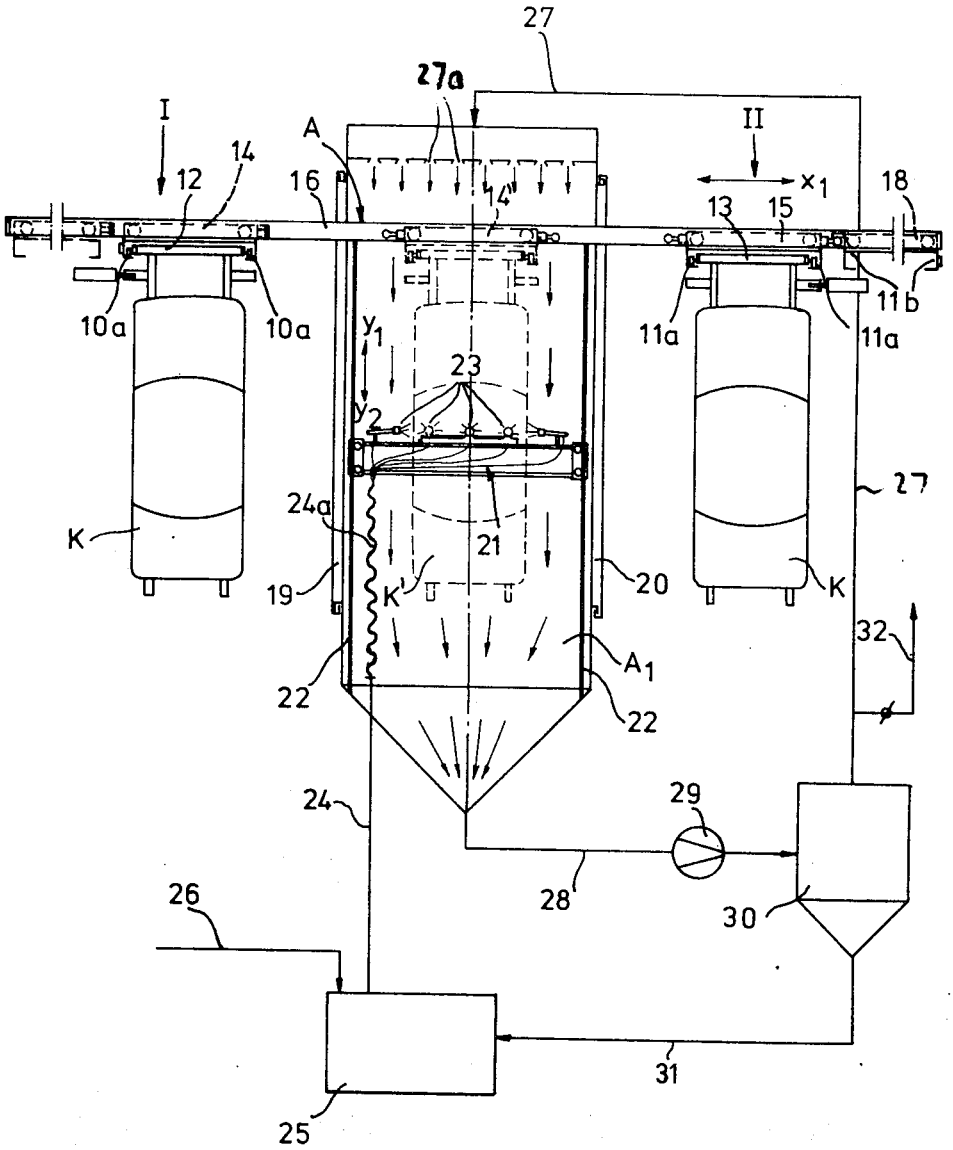
FIG. 2 is a somewhat diagrammatic vertical section through a portion of the apparatus in FIG. 1, and in particular through one of the spray booths shown therein.

By way of explanation it will be assumed that the workpieces to be treated are vehicle bodies A which are suspended from carriages, such as the carriages 12 and 13, in a vertical sense, that is in such a manner that the vehicle bodies are suspended in the direction of their longitudinal axes as shown for instance in FIG. 2. The rails 10 and 11, incidentally, are of substantially U-shaped profile, as most clearly seen in FIG. 2.

In order to make it possible to transfer the workpieces K from the track I to the respective working stations $A_1$ etc., and from there to the track II, the rails 10 and 11 are interrupted where the transverse tracks A-D are present, and are bridged in known manner by rail portions 10a and 11a, respectively, supported on carriages 14 and 15 which travel on rails 16 of the trails A-D. The ends of the rails 16 extend laterally beyond the tracks I and II, respectively, so that at the projecting end portions it is possible to locate carriages 17, 18, in the event that it is desired to store vehicle bodies in suspended condition laterally outwardly of the tracks I and II, respectively, for later transportation.

Figure 3:
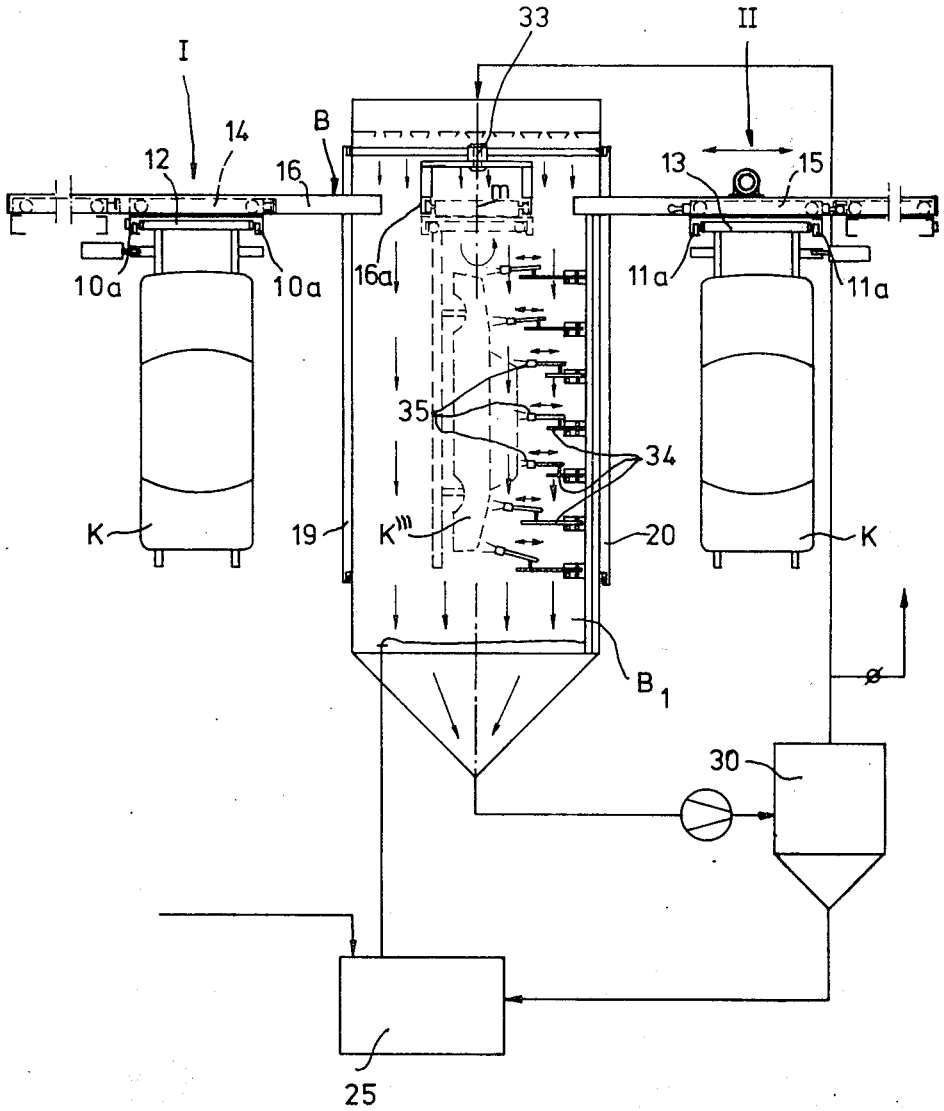
FIG. 3 is a view similar to FIG. 2, illustrating a different spray booth that is also used in the apparatus of FIG. 1.

FIGS. 2 and 3 show two different spray stations $A_1$ and $B_1$, respectively. It should be understood that both of these possibilities can be incorporated in a single apparatus, as is indeed shown in FIG. 1, although normally only one or the other type will be employed in a single apparatus.

Referring now more particularly to FIG. 2 it will be seen that the spray booth at the station $A_1$ is traversed by the rails 16 which continuously extend through it, that is which are not interrupted. At opposite sides of the booth at the respective stations $A_1$-$D_1$, there are provided openings which can be closed by doors 19 and 20, respectively. In the illustrated embodiment these doors are sliding doors which can move in direction normal to the plane of FIG. 2 or FIG. 3, respectively. This makes it possible to introduce the workpieces into and remove them from the respective booths, as indicated by the arrow $x_1$ shown in FIGS. 2 and 3.

The workpiece K is shown in the position K′ in FIG. 2, located in the booth at the station $A_1$. It is now to be powder coated by electrostatic spraying. For this purpose, the station $A_1$ is provided with a spraying arrangement 21 which can be moved vertically up and down within the booth, in the direction of the double-headed arrow $y_1$-$y_2$, for which purpose it is mounted on four upright guide rails 22 (compare FIG. 1). The spraying arrangement 21 is provided with a plurality of spraying nozzles 22 which are conventional and known from powder-spraying techniques. The powder required for spraying and deposition on the workpiece by electrostatic means is supplied to the nozzles 23 via a conduit 24 having a flexible portion 24′. The conduit 24 receives it from a feeding device 25 which receives fresh powder from a conduit 26 from a source that is not illustrated. The manner in which the powder is supplied and electrostatically charged is part of the art, and reference may be had to the aforementioned sources for information.

A closed air circulating system is provided, in which air is admitted via the conduit 27 at the top of the station $A_1$, to become distributed over the cross section of the station through a plurality of nozzles 27*a* so as to travel as uniformly as possible —preferably in a spiral shape— through the booth at the station $A_1$, from the top to the bottom of the latter. At the bottom the air stream and any powder that it has entrained is withdrawn via the conduit 28 and the interposed pump 29, and is then admitted into a device 30 —such as a cyclone— wherein the paint is separated from the air and is returned via the conduit 31 to the device 25. The air which has been freed of the paint is returned into the conduit 27, or if desired it can be discharged to the ambient atmosphere via a branch conduit 32 with the illustrated interposed valve.

The workpiece, for instance the vehicle body K, is first subjected to whatever treatments it must have preliminary to the operation of the powder spray, for instance by dipping it into a bath where it is subjected to electrophoretic application of lacquer. Thereupon, it is transported in the direction of the arrow *a* in the path defined by the track I until it is located opposite that station $A_1$-$D_1$ wherein the color is being sprayed that is desired. Now, the workpiece is shifted transversely on its carriage after first the appropriate door at the station has been opened, and is introduced into the station, whereupon the door is closed. The workpiece is now in the position K′, and the spraying arrangement 21 can move in the direction of the double-headed arrow $Y_1$- $Y_2$ in upward and downward direction, assuming that the workpiece has been introduced into the station $A_1$. After completion of the spraying operation the door 20 is opened and the workpiece is shifted to the track II, that is the carriage 14 supporting the workpiece is moved from the position 14′ which it had previously assumed in the station $A_1$ to a position in which it is located on the track II. The carriage 12 which moves with the carriage 14 can now be moved off the carriage 14 and onto the rails 11 of the track II, to be transported in the direction of the arrow *b* to any further processing station, for instance an arrangement for drying the applied powder, or it can be stored in the position of the carriage 18, after the carriage 18 has been removed. It is self-evident that before the workpiece can be moved to the track II, the workpiece K which is shown in FIG. 2 to be already present on the track must have been transported away from its location opposite the station $A_1$.

The embodiment in FIG. 3 is explained with reference to the station $B_1$. It differs in essence from the embodiment shown in FIG. 2 in that the rails 16 are interrupted within the confines of the station $B_1$, so that the separate section of rails 16 which is located within the confines of the station $B_1$ and which is identified with reference numeral 16*a*, can be turned about the central vertical axis *m* of the station $B_1$, about a journal 33. This means that when the workpiece K has been moved into the station $B_1$ it can be turned about its longitudinal axis, for instance to the position K″ shown in FIG. 1 in which the workpiece is turned through 45°, and to the position K‴ shown in FIG. 3, in which the workpiece is turned through 90°. In this embodiment, the spray nozzles are identified with reference numeral 35 and are not movable vertically as indicated in FIG. 2 by the arrow $Y_1$-$Y_2$, although if desired such a possibility of displacement can evidently be incorporated in FIG. 3. In the latter Figure, however, it is advantageous if the nozzles 35 are shiftable in transverse direction, that is substantially radially of the station $B_1$, and they may be program-controlled in such a manner that they follow the contours of the workpiece K as the latter turns past the nozzles 35, so as to assure that the space between each nozzle and the juxtaposed surface portion of the workpiece is as uniform as possible at all times. This provides a much more uniform application of the powder layer on the workpiece.

In all respects, the embodiment of FIG. 3 operates in the same manner as that of FIG. 2. It may be advisable to make the spray arrangement having the nozzles 35 shiftable in vertical direction by a certain distance (but not to make it reciprocable as in FIG. 2) simply to move it out of the way of the workpiece as the same enters and leaves the station $B_1$. It is self-evident that the substantially radial movement of the nozzles 35 in FIG. 3 could be incorporated in the embodiment of FIG. 2. It is also clear that this displacement need not be strictly radial, but that the nozzles can be moved in such a manner that they will have at least a component of movement in the direction in which they eject sprays of powder.

Figure 4:
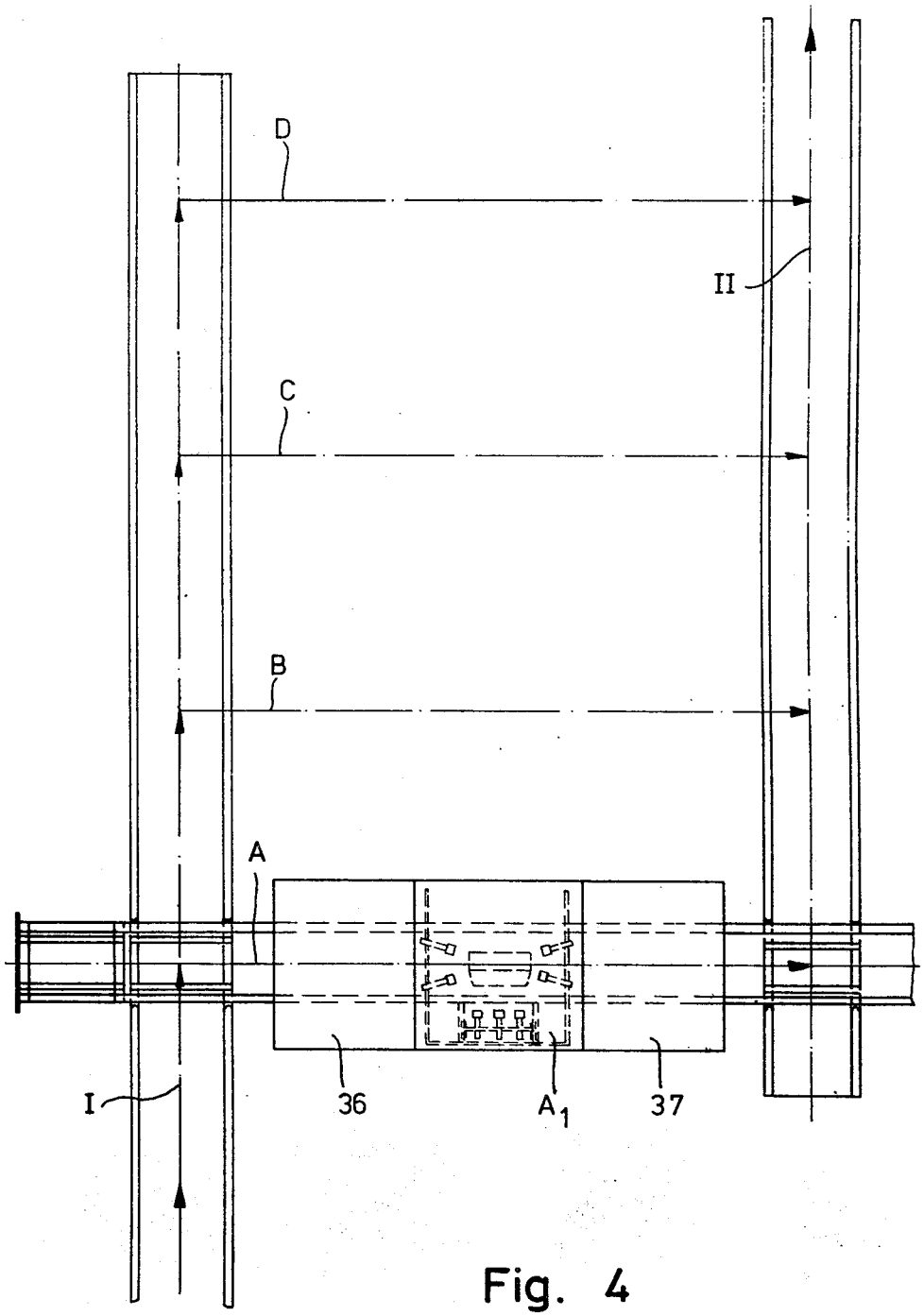
FIG. 4 is a diagrammatic fragmentary top-plan view analogous to FIG. 1, but illustrating a further embodiment of the invention.

Coming, finally, to the embodiment in FIG. 4 it will be seen that this essentially corresponds to the embodiment of FIG. 1, except that each of the stations $A_1$-$D_1$ is provided with a preliminary chamber 36 and/or with a terminal chamber 37 through which the workpiece must pass before entering and after leaving the station, respectively. These chambers 36 and 37 may also be provided with slidable doors, or simply with curtains in the manner known from the art. The stations $B_1$,$C_1$, and $D_1$ have been shown only by way of example in FIG. 4 and very diagrammatically. Evidently, any of the stations $A_1$-$D_1$ in FIG. 4 can be constructed in accordance with the embodiment of FIG. 2 or the embodiment of FIG. 3.

In FIG. 4 the provision of the chambers 36 and 37 has the advantage of further reducing the possibility that the powder might escape from the respective station when one or the other of the doors 19, 20 is open. This is particularly advantageous if only relatively little time is available between the termination of the spraying operation and the time at which the door must be opened to discharge the treated workpiece, or to admit a new one. It is also possible to provide a flow of air in the chambers 36, 37 which is so directed that the provision of doors or curtains is eliminated. Evidently, the chambers 36 and 37 can be used not only as safety locks to prevent the escape of powder from the respective station, but they can also be used as working stations, that is preliminary work prior to the spraying can be carried out in the chamber 36, and any subsequent additional work after the spraying can be carried out in the chamber 37, if such should be necessary.

Various modifications in the illustrated embodiments are possible and will offer themselves to those skilled in the art. For instance if sufficient space is available in vertical direction, it would be possible to admit the workpieces from above into the respective stations, so that the booth at each station can be circumferentially permanently and completely closed. Similarly, it might be conceivable to admit the workpieces from below, although this would present problems of preventing the escape of powder in downward direction.

Evidently, various types of workpieces can be processed in this manner, not only vehicle bodies which have been described and illustrated by way of example. Moreover, the invention is not limited to the spraying of powder onto the workpieces, but can also be used in the application of liquid paints or lacquers. A single one or several of the carriages 14, 15, 17 or 18 can be provided on each of the transverse tracks A-D, or two or more can be provided. For instance, two of the carriages 17 or two of the carriages 18 could be provided, so long as the tracks A-D, that is the rails 16 thereof, extend laterally beyond the tracks I and II by a sufficient distance to accommodate the excess carriages which would then be used only if and when needed.

It will be understood that each of the elements described above, or two or more together, may also find a useful application in other types of constructions differing from the types described above.

While the invention has been illustrated and described as embodied in an apparatus for treating a workpiece at a treating station, it is not intended to be limited to the details shown, since various modifications and structural changes may be made without departing in any way from the spirit of the present invention.

Without further analysis, the foregoing will so fully reveal the gist of the present invention that others can by applying current knowledge, readily adapt it for various applications without omitting features which, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. An apparatus for treating a workpiece at treating stations, particularly for applying a surface coating to a vehicle body or the like, comprising a first elongated conveyor defining a first path for travel of a suspended workpiece; a second elongated conveyor defining a second path transversely spaced from said first path for travel of a suspended treated workpiece; a plurality of treating stations intermediate said paths and spaced from one another longitudinally of said paths; and a plurality of guide tracks, each extending from said first to said second conveyor at a respective one of said treating stations, at least some of said guide tracks are provided at the respectively associated treating station with a track station which is turnable about a vertical axis, so that a workpiece suspended from said track section is turnable about said axis with reference to the respective treating station.

2. An apparatus as defined in claim 1, wherein said treating stations comprise a painting booth at each of said treating stations, and a plurality of spray nozzles in each of said painting booths.

3. An apparatus as defined in claim 2, further comprising means for effecting relative movement between said workpiece and said spray nozzles in the respective painting booth.

4. An apparatus as defined in claim 3, wherein said means for effecting relative movement causes movement of said spray nozzles to said workpiece at the respective booth in a vertical direction.

5. An apparatus as defined in claim 3, wherein said spray nozzles eject streams of material towards said workpiece; and wherein said means for effecting relative movement causes movement of said spray nozzles relative to said workpiece in a direction having at least a component of movement longitudinally of said streams.

6. An apparatus for treating a workpiece at treating stations, particularly for applying a surface coating to a vehicle body or the like, comprising a first elongated conveyor defining a first path for travel of a suspended workpiece; a second elongated conveyor defining a second path transversely spaced from said first path for travel of a treated suspended workpiece; a plurality of treating stations intermediate said paths and spaced from each other longitudinally of said paths, each of said treating stations comprising a painting booth and a plurality of spray nozzles at each of said painting booths, each of said painting booths being provided with slidable doors at opposite sides for entering and exit of said workpiece; and a plurality of transverse guide tracks each extending from said first to said second conveyor at a respective one of said treating stations.

7. An apparatus for treating workpieces at treating stations, particularly for applying a surface coating to a vehicle body or the like, comprising a first elongated conveyor defining a first path for travel of a suspended workpiece; a second elongated conveyor defining a second path traversely spaced from said first path for travel of a treated suspending workpiece; a plurality of treating stations intermediate said paths and spaced from each other longitudinally of said paths, each of said treating stations comprising a painting booth, spray nozzles at each of said painting booths, and at least one chamber associated with each of said painting booths through which said workpiece travels during transfer from said first to said second path; and means for transferring a workpiece from said first path to a selected one of said treating stations, and from the latter to said second path, said means comprising a plurality of guide tracks, each extending from said first to said second conveyor at a respective one of said treating stations.

8. An apparatus for treating workpieces at treating stations, particularly for applying a surface coating to a vehicle body or the like, comprising first elongated guide rails defining a first path for travel of a suspended workpiece; second elongated guide rails defining a second path transversely spaced from said first path for travel of a treated suspended workpiece; a plurality of treating stations intermediate said first and second guide rails and spaced from each other longitudinally of said paths; means for transferring a workpiece from said first path to a selected treating station, and from the latter to said second path, said means comprising a plurality of transverse guide tracks, each intersecting said first and second elongated guide rails at a respective one of said treating stations, said first and second elongated guide rails being interrupted between each of said transverse guide tracks and said means further comprising a first carriage on each of said transverse guide tracks movable on the respective guide track and being provided with guide rail sections adapted to bridge said interrupted guide rails in a predetermined position of said first carriage; and at least one second carriage movable along said guide rails and onto said guide rail sections in said predetermined position of said first carriage, said workpiece being suspended on said second carriage so that, when said second carriage is located on said guide rail sections of a respective first carriage, said second carriage and said workpiece suspended thereon may be moved by said first carriage from one of said guide rails to a respective treating station and from the latter to the other of said guide rails.

9. An apparatus as defined in claim 8, wherein a plurality of second carriages is provided, and wherein each of said transverse guide tracks projects from each of said guide rails in a direction away from said other guide rail for storing any of said second carriages.

10. An apparatus for treating workpieces at treating stations, particularly for applying a surface coating to a vehicle body or the like, comprising first means defining a first path for travel of a suspended workpiece; second means defining a second path for travel of a treated suspended workpiece; third means intermediate and spaced from said paths and defining a plurality of treating stations spaced from each other longitudinally of said paths; and fourth means for transferring a suspended workpiece from said first path to said treating stations for treatment and for transferring the treated workpiece from said treating stations to said second path, each of said treating stations including a chamber arranged substantially below said fourth means and having a vertical dimension greater than the spacing between adjacent chambers and the spacing of each chamber from each of said paths.

11. An apparatus as defined in claim 10, wherein said first and second means comprises first and second elongated conveyors, respectively.

12. An apparatus as defined in claim 10, wherein said fourth means comprises a plurality of transverse guide tracks each extending from said first means to said second means at a respective one of said treating stations.

* * * * *